US006773194B2

(12) United States Patent
Libman et al.

(10) Patent No.: US 6,773,194 B2
(45) Date of Patent: Aug. 10, 2004

(54) SOAP-DISPENSING SCRUBBER

(75) Inventors: Robert J. Libman, Champaign, IL (US); Marco Bizzotto, Padua (IT)

(73) Assignee: The Libman Company, Arcola, IL (US)

( * ) Notice: Subject to any disclaimer, the term of this patent is extended or adjusted under 35 U.S.C. 154(b) by 3 days.

(21) Appl. No.: 10/167,784

(22) Filed: Jun. 12, 2002

(65) Prior Publication Data

US 2003/0231924 A1 Dec. 18, 2003

(51) Int. Cl.[7] ..... B43K 8/12
(52) U.S. Cl. ..... 401/207; 401/205
(58) Field of Search ..... 44/266, 265, 263, 44/205; 15/22.1; 206/362.2, 15.2, 15.3

(56) References Cited

U.S. PATENT DOCUMENTS 1,169,977 A * 2/1916 Luchtenberg ..... 401/281
2,702,396 A * 2/1955 Straszer ..... 401/281
2,827,650 A * 3/1958 Morrill et al. ..... 401/186
3,390,941 A * 7/1968 Weber ..... 401/205
4,089,609 A * 5/1978 Gring et al. ..... 401/130

FOREIGN PATENT DOCUMENTS

EP 161 113 * 11/1985 ..... 401/205

* cited by examiner

*Primary Examiner*—David J. Walczak
(74) *Attorney, Agent, or Firm*—Marshall, Gerstein & Borun LLP

(57) ABSTRACT

A soap-dispensing scrubber has a base with a sponge on one side and a reservoir on the other side. The reservoir has an open-ended wall that rotates between a dispensing position, a closed position, and a removable position. In the closed position, a sealing surface closes a soap aperture in the base. Ridges are used to hold the base and the reservoir together. A projection and a recess on the ridges prevent inadvertent rotation of the parts.

2 Claims, 4 Drawing Sheets

SOAP-DISPENSING SCRUBBER

BACKGROUND OF THE INVENTION

The present invention relates generally to scrubbers, and more particularly to scrubbers for household use.

Household scrubber are often used with a mild detergent such as a liquid soap. Efforts have been made to incorporate soap dispensers into scrubbers, with little known commercial success.

BRIEF DESCRIPTION OF THE INVENTION

A convenient new soap-dispensing scrubber has been developed. The scrubber includes a base with a sponge on one side and a reservoir on the other side. A soap aperture extends through the base. The reservoir is enclosed within an open-ended reservoir wall that rotates about the base between a dispensing position and a closed position. In the closed position, a sealing surface within the reservoir wall closes the soap aperture. Thus, a user can selectively open or close the soap aperture.

The invention can be implemented in a variety of ways. In one embodiment of the invention, the base and the reservoir wall are held together by ridges. For example, a plurality of regularly-spaced ridges may be formed on both the second side of the base and the reservoir wall. Such ridges on the reservoir wall may have upper edges that engage lower edges on the ridges on the base to hold the base to the reservoir wall. Such pieces can be rotated to a removable position where discontinuities in the ridges permit the two pieces to be separated, allowing a user to add more soap to the reservoir.

A projection and a recess can be incorporated into the base and reservoir wall to prevent inadvertent rotation. For example, a radially-outward projection can be provided on the reservoir wall, and arranged to fit into a recess in the base when the reservoir wall is in the closed position. A snug fit between the projection and the recess can serve to effectively lock the reservoir wall and base into the desired position. A second recess can be provided to help hold the pieces together in the dispensing position.

The sealing surface can also be arranged in a variety of ways. For example, if the soap aperture is arranged to extend through a raised segment on the second side of the base, the sealing surface can be arranged as a rigid surface with upper and lower sections that are disposed at different distances from the second side of the base. Both the reservoir wall and the sealing surface may be part of a single, molded piece.

BRIEF DESCRIPTION OF THE DRAWINGS

The invention may be better understood by referring to the accompanying drawings, in which.

DETAILED DESCRIPTION OF THE DRAWINGS

Figure 1:
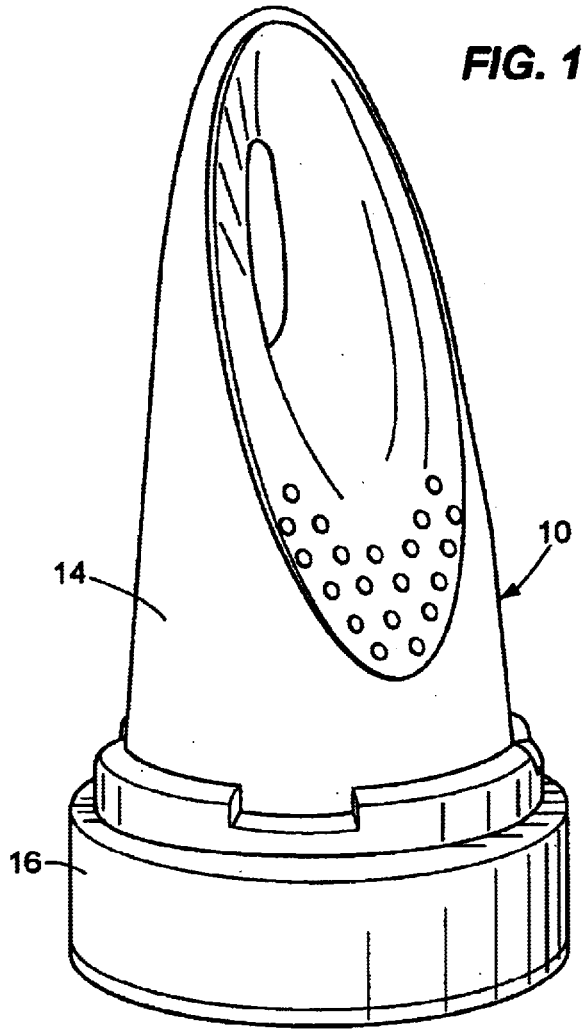
FIG. 1 is a perspective view of a soap-dispensing scrubber in accordance with one embodiment of the invention.
Figure 2:
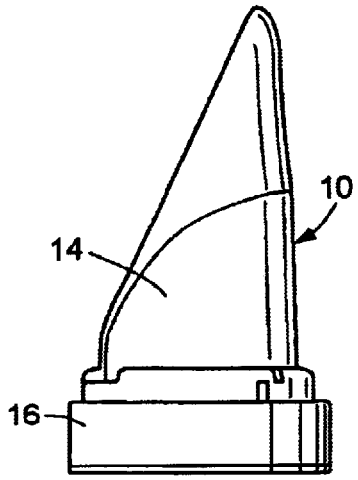
FIGS. 2 and 3 are reduced side and front views of the scrubber seen in FIG. 1.
Figure 3:
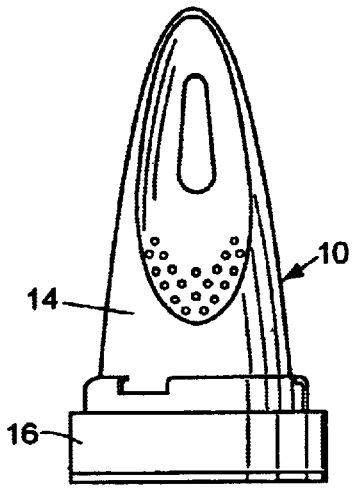

FIGS. 1–3 show one embodiment of a soap-dispensing scrubber 10 in accordance with the present invention. The scrubber includes a reservoir section 14 and a base section 16.

Figure 4:
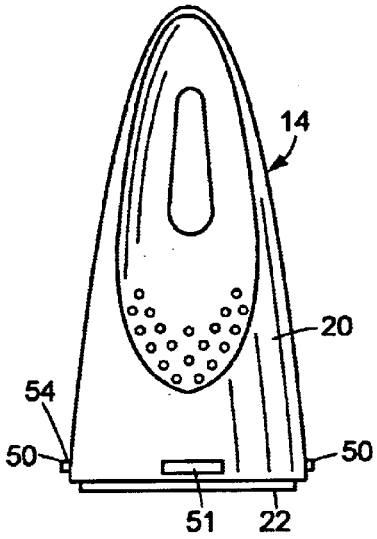
FIGS. 4–6 are reduced front, side, and top views of the reservoir section of the scrubber seen in FIG. 1.
Figure 5:
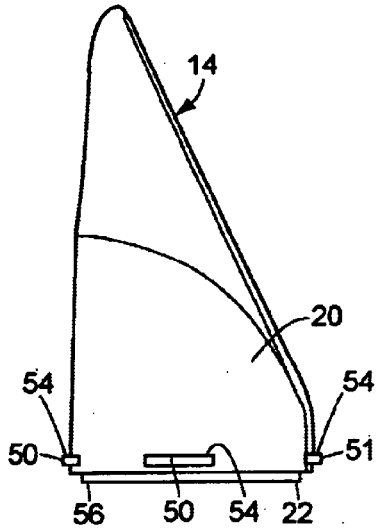
Figure 6:
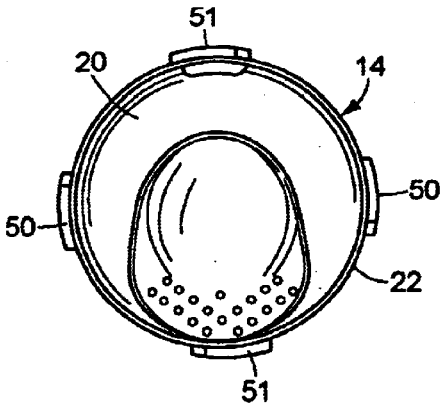

As seen in FIGS. 4–6, the reservoir section 14 includes an open-ended reservoir wall 20. In the embodiment of the invention that has been illustrated, the reservoir wall has a circular rim 22 that has a diameter of approximately 2¼". The illustrated reservoir section is made of approximately ⅛"-thick rigid plastic and has an ornamental, generally-conical configuration that is approximately 4½" tall. Other shapes and configurations could be used. The illustrated shape provides an interior volume capable of holding up to about 4 ounces of liquid soap.

Figure 7:
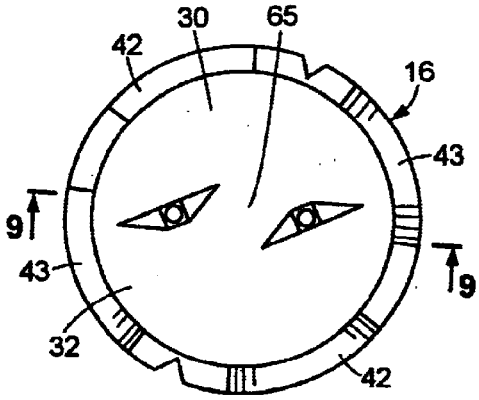
FIGS. 7 and 8 are reduced top and side views of the base section of the scrubber seen in FIG. 1.
Figure 8:
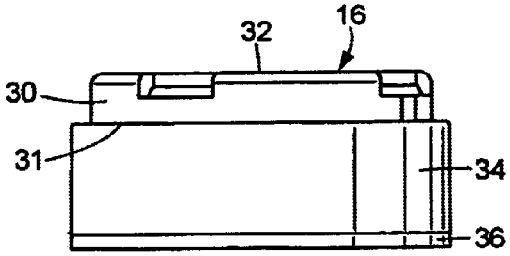

As seen in FIGS. 7 and 8, the base section 16 includes a base 30 that has a first side 31 (FIG. 8) and a second side 32. A scrubbing element 34 is connected to the first side of the base. The illustrated scrubbing element is a disk-shaped sponge that has been glued to the base. It includes an optional scrub pad 36 on the lower surface of the sponge. The details of the scrubbing element and how it is attached to the base section are not important to the invention, and many other arrangements or configurations could be used. For example, a set of bristles could be used.

The base 30 has a shape that corresponds with the rim 22 on the open end of the reservoir section 14. The illustrated base has a circular shape, and is sized slightly larger than the bottom of the reservoir wall 20. In the illustrated embodiment, the base is made of approximately ⅛" thick rigid plastic, and is about 2½" in diameter. Other shapes and arrangements could also be used.

Figure 9:
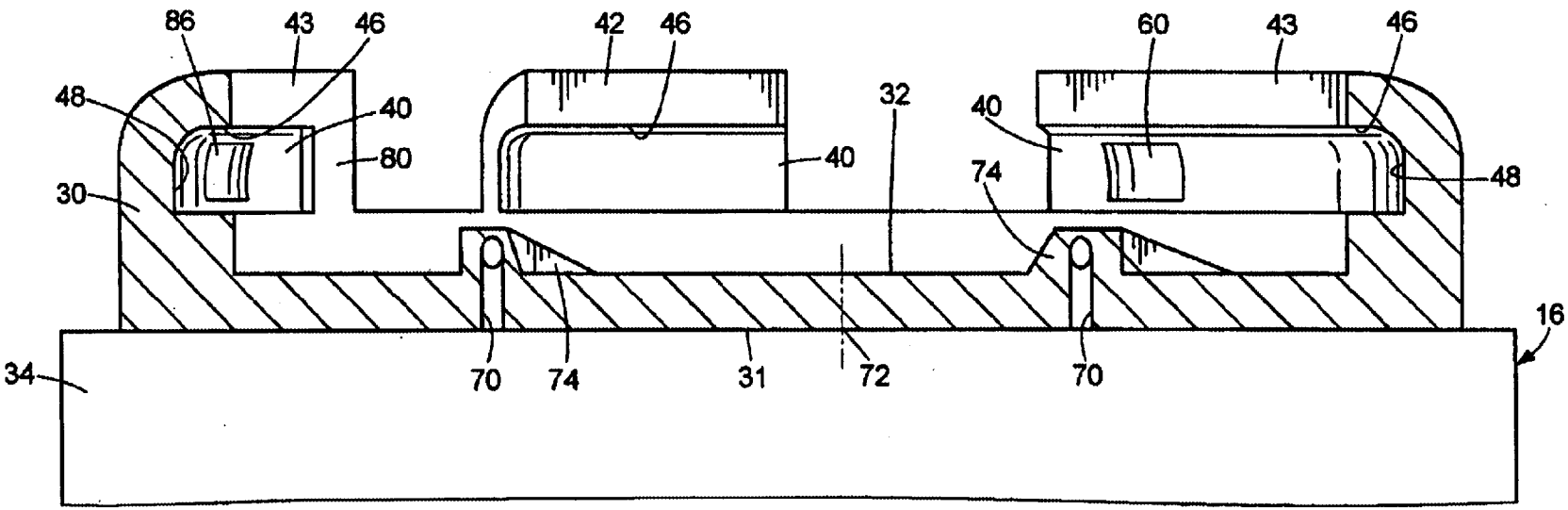
FIG. 9 is an enlarged sectional view through lines 9—9 of FIG. 7.

As seen in FIG. 9, the illustrated base 30 has cylindrical collar segments 40 that rise from the periphery of the second side 32 of the base. A plurality of regularly-spaced ridges 42, 43 are disposed on the collar segments about ¼" above the base, and extend inwardly about 1/16" from the collar segments. Each of the ridges has a lower edge 46, which forms part of a radial slot 48 between the ridge and the second side of the base. In the illustrated embodiment of the invention, the ridges 42 are diametrically-opposed arcs, each of which extends over a range of approximately 52°. The ridges 43 are also diametrically-opposed arcs, and extend over a range of approximately 60°. Each ridge 42 is spaced about 30° from one of the ridges 43, and about 38° from the other ridge 43, resulting in two sets of diametrically-opposed gaps between the ridges, one set of gaps being larger than the other. While this particular arrangement is useful for connecting to the disclosed reservoir section, other configurations could be used for disclosed reservoir section, or for other reservoir sections utilizing the present invention.

The reservoir wall 20 that is illustrated in FIGS. 4 and 5 is designed for being removably-connected for rotation with respect to the illustrated base 30. The reservoir wall includes a plurality of outwardly-projecting ridges 50, 51, each of which has an upper edge 54. The ridges are disposed about ¼" from the rim 22 of the reservoir wall, and extend outwardly about 1/16" from the reservoir wall. In the illustrated embodiment of the invention, an optional o-ring 56 has been providing beneath the ridges 50, 51.

In the illustrated embodiment of the invention, the ridges 50 on the reservoir wall 20 are diametrically-opposed arcs, each of which extends over a range of approximately 27°.

The ridges 51 are also diametrically-opposed arcs, and extend over a range of approximately 30°. Each ridge 50 is spaced about 58° from one of the ridges 51, and about 65° from the other ridge 51, resulting in two sets of diametrically-opposed gaps between the ridges, one set of gaps being larger than the other. Other spacings and arrangements could also be used.

The illustrated reservoir section 14 and base section 16 can be secured together by twisting. First, the reservoir section is held with the rim 22 facing upwards. Then, the second side 32 of the base 30 is placed over the rim 22 of base in a removable position, with each of the smaller ridges 50 on the reservoir section falling into one of the smaller gaps between the ridges 42, 43 on the base, and each of the larger ridges 51 falling into one of the larger gaps between the ridges on the base.

From this removable position, the base section 16 can be secured to the reservoir section 14 in a dispensing position by rotating the base 30 with respect to the reservoir wall 20 so that the ridges 50, 51 on the reservoir section slide into the slots 48 between the ridges 42, 43 on the base and the second side 32 of the base. Once the ridges on the reservoir section are within the slots, the upper edges 54 on the ridges on the reservoir section and the lower edges on the ridges on the base interfere with each other, holding the reservoir section and the base section together.

Figure 10:
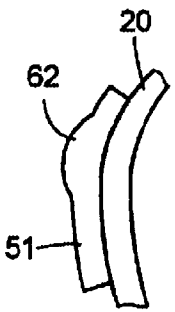
FIG. 10 is an enlarged top view of one of the ridges on the reservoir section.

Some of the ridges may be provided with projections that fit within a recess to inhibit unintentional rotation of the base section 16 with respect to the reservoir section 14. In FIG. 9, for example, a first recess 60 is provided adjacent one of the ridges 43 on the base section. A radially-outward projection 62 on one of the ridges 51 on the reservoir wall 20 (seen in FIG. 10) fits into the first recess when the reservoir wall is in the dispensing position, reducing the chance of the base section and reservoir section unintentionally coming apart. The projections and corresponding recesses could be placed on other ridges, or reversed in position.

The base section 16 has a soap aperture 70 that extends from the first side 31 of the base 30 to the second side 32 of the base. In the dispensing position, liquid contained within the reservoir can flow through the soap aperture to the scrubber 34. Preferably, the aperture is located at a distance from the center point 72 of the base. In the illustrated embodiment of the invention, the base is provided with two soap apertures, each having a diameter of approximately 1/16". Each of the apertures extends through a raised segment 74 on the second side of the base.

Figure 11:
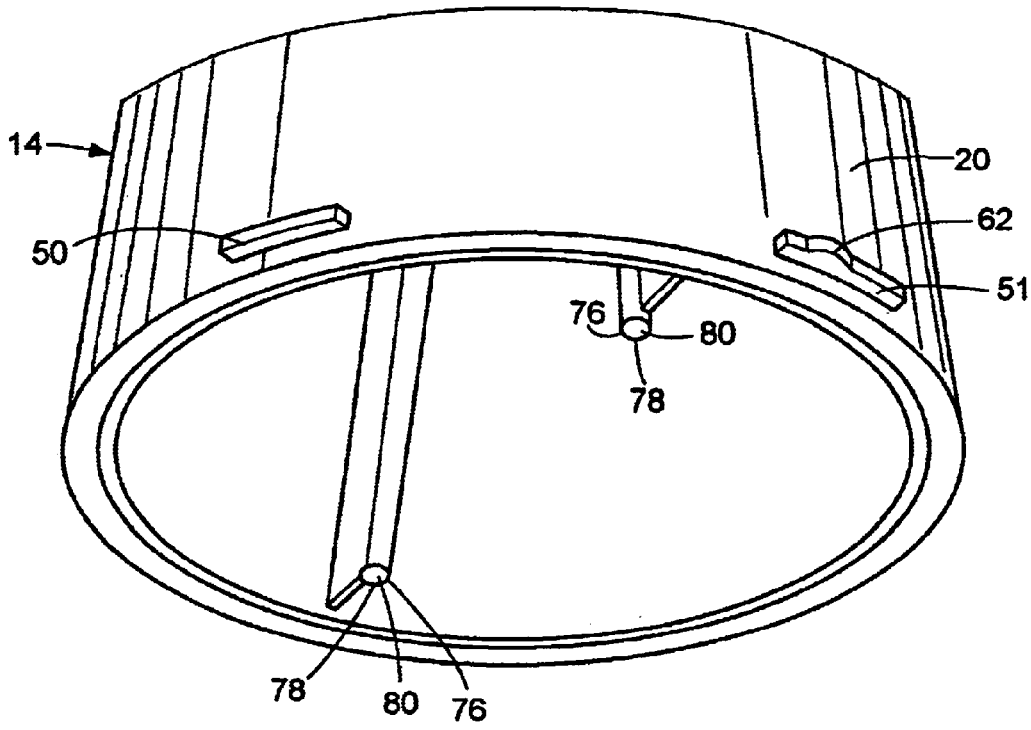
FIG. 11 is an enlarged, perspective view of the reservoir section.

The reservoir section 14 and the base section 16 can be rotated beyond the dispensing position to a closed position in which flow of liquid through the soap apertures 70 is prevented. As seen in FIG. 11, a sealing surface 80 is disposed within the reservoir wall 20. When the base 30 and the reservoir wall 20 are rotated to the position where the sealing surface covers the soap aperture, flow of liquid through the aperture is blocked. In the embodiment of the invention that has been illustrated, the reservoir section has two sealing surfaces, each of which is an integral part of the reservoir section, and has upper and lower sections 76, 78 that are disposed at different distances from the second side of the base. This configuration is designed to fit closely against the mouth of the soap apertures. Other configurations of sealing surfaces, such as a resilient rubber flap, could also be used.

The illustrated embodiment of the invention includes an optional second recess 86 (FIG. 9) adjacent one of the ridges. When the reservoir section 14 and the base section 16 are in the closed position, the projection 62 on the ridge 51 (FIGS. 10 and 11) fits within the second recess to help hold the parts in the closed position.

The illustrated embodiment of the invention also includes an optional stop 80 (FIG. 9) that prevents incorrect rotation of the base section with respect to the reservoir section 14. The illustrated stop prevents the user from inadvertently rotating the base and the reservoir wall in the wrong direction when the sections are in either the removable or closed positions.

This description of one embodiment of the invention has been provided merely for illustrative purposes. The scope of the invention is set forth in the following claims.

What is claimed is:

1. A soap-dispensing scrubber comprising:

a base that has a first side and a second side;

a scrubbing element that is connected to the first side of the base;

a soap aperture extending from the first side of the base to the second side of the base and extending through a raised segment on the second side of the base;

an open-ended reservoir wall that is connected for rotation with respect to the base between a dispensing position and a closed position; and a sealing surface that is disposed within the reservoir wall at a position that closes the aperture when the reservoir wall is in the closed position.

2. A soap-dispensing scrubber comprising:

a base that has a first side and a second side;

a scrubbing element that is connected to the first side of the base;

a soap aperture extending from the first side of the base to the second side of the base and extending through a raised segment on the second side of the base;

an open-ended reservoir wall that is connected for rotation with respect to the base between a dispensing position and a closed position; and a rigid sealing surface disposed within the reservoir wall and having upper and lower sections that are disposed at different distances from the second side of the base and closes the aperture when the reservoir wall is in the closed position.

* * * * *